US008962959B1

(12) United States Patent
Mier

(10) Patent No.: US 8,962,959 B1
(45) Date of Patent: Feb. 24, 2015

(54) ADJUSTABLE FLEXTURE PICK FOR STRINGED INSTRUMENTS

(71) Applicant: Ralph William Mier, Camarillo, CA (US)

(72) Inventor: Ralph William Mier, Camarillo, CA (US)

( * ) Notice: Subject to any disclaimer, the term of this patent is extended or adjusted under 35 U.S.C. 154(b) by 0 days.

(21) Appl. No.: 13/815,594

(22) Filed: Mar. 11, 2013

Related U.S. Application Data

(60) Provisional application No. 61/634,986, filed on Mar. 10, 2012, provisional application No. 61/687,611, filed on Apr. 28, 2012.

(51) Int. Cl.
*G10D 3/16* (2006.01)

(52) U.S. Cl.
CPC ..... *G10D 3/163* (2013.01)
USPC ..... 84/322

(58) Field of Classification Search
USPC ..... 84/315–317, 320–22
See application file for complete search history.

(56) References Cited

U.S. PATENT DOCUMENTS

| | | | | |
|---|---|---|---|---|
| 2,459,274 | A | 1/1949 | Galetzky | |
| 4,228,719 | A | 10/1980 | Keene | |
| 4,625,616 | A * | 12/1986 | McVicker | 84/322 |
| 5,648,622 | A | 7/1997 | Storey | |
| 2005/0223872 | A1 * | 10/2005 | Greenwald | 84/322 |

* cited by examiner

*Primary Examiner* — Kimberly Lockett

(57) ABSTRACT

A pick or plectrum for a stringed musical instrument comprising an upper body, a generally triangular shaped lower body with appendages extending adjacent to the planar perimeter of the upper body, and an intermediate portion of less width than the upper body and lower body, and having greater flexibility than the upper body and lower body. The player can grip the pick with a thumb and index finger on opposing sides of the upper body, and strike the strings with the lower body. The player can modify the amount of flexibility of the pick by engaging the appendages of the lower body through the application of more pressure upon the pick, thereby flattening the thumb and index finger onto the adjacent lower body appendage, or by rolling the thumb and finger in a more natural lateral fashion upon a lower body appendage. The lower body and appendages provide a smooth leading edge so as no to grab or rake the strings.

6 Claims, 6 Drawing Sheets

ADJUSTABLE FLEXTURE PICK FOR STRINGED INSTRUMENTS

RELATED APPLICATIONS

This application claims the benefit of U.S. Provisional Application 61/634,986 filed on Mar. 10, 2012 entitled "Hinged Pick for Stringed Musical Instruments", and U.S. Provisional Application 61/687,611 filed on Apr. 28, 2012 entitled "Hinged Pick for Stringed Musical Instruments," which are incorporated herein in their entirety by reference.

BACKGROUND

1. Field of the Invention

The present invention relates to picks or plectrums used in the strumming or plucking of stringed musical instruments. A pick is generally of a triangular shape, and is grasped between the index finger and thumb. The wider upper-body of a pick is generally used for gripping the pick, and the opposing pointed end is used to pluck the strings individually, or strum the strings collectively. The pointed lower-body of a pick is generally perpendicular to the player's thumb, because it is a more relaxed position, as the player's forearm, hand, and thumb appendage are parallel to the body of the stringed musical instrument.

Both the stiffness and the material of the pick can make a considerable difference regarding the tone or sound quality that the strumming or plucking produces. Although the vernacular surrounding the description of sound differences is somewhat deficient, a stiffer pick will produce a heavier, louder, and more resonant tone, by means of the force applied to the strings, and a more flexible pick will produce a softer, quieter, and less resonant tone. A player often desires to quickly and comfortably alternate between plucking and strumming the strings, and alternate between the different tones afforded by the relative stiffness or flexibility of the pick.

Likewise, the material of the pick affects the tone that the strumming or plucking produces, independent and irrespective of the actual force applied to the string by means of the stiffness or flexibility of the pick. Although similarly described as tone, the relatively muted sound of soft and flexible plastic upon a string is distinctly different from the crisper, sharper, brighter, clearer, and "metallic" sound of hard plastics or metal alloys upon the same string.

It is often desirable, when playing a stringed musical instrument, to produce the sharper sounds of harder materials, while maintaining the ability to readily, easily, and comfortably adjust or modify the stiffness or flexibility of the pick. The pick according to the present invention allows the player to quickly adjust the stiffness or flexibility of the pick with a slight, comfortable, and natural movement of the player's thumb and index finger, and achieve the resulting tonal differences and greater tactile sensitivity afforded by different materials. Lastly, the above described benefits of the present invention are achieved without obstructions in the pick design so as not to grab or rake the strings.

2. Prior Art

Prior attempts have been made to allow the player to adjust the stiffness of the pick without undertaking the step of replacing or interchanging picks. For example, the Keene U.S. Pat. No. 4,228,719 describes a pick in which the different playing corners of the pick admit of varying degrees of flexibility due to differently sized apertures. However, in the course of play, transferring between the different flexibility points would require a prolonged cessation in play, and an additional hand, or an impractical or difficult degree of single hand manipulation.

Similarly, Galetzky U.S. Pat. No. 2,459,274 describes a complex slide mechanism which would require a prolonged cessation in play, and an additional hand, or an impractical or difficult degree of single hand manipulation.

Finally, the Storey U.S. Pat. No. 5,648,622 describes a pick with lateral flexture points across the midline of the pick. However, because a player's thumb is generally parallel to such flexture points, any adjustment in flexture, requires the aid of a separate hand for adjustment, pressing of the pick against another surface, or an uncomfortable vertical roll of the thumb toward or away from the pointed tip of the pick. Further, such vertical rolling of the thumb and index finger changes the position of the player's original and preferred vertical placement upon the pick.

Additionally, in several embodiments, the lateral obstructions in the pick can rake or grab the strings while in use and can dislodge the pick from the player's fingers, create unintended sounds, or potentially break the strings. Further, an added benefit of a lower body as distinct from the upper body is that a thicker material may be used for the lower body. The thicker lower portion allows for a graduated or tapered point, instead of a flat tip that tends to slap the strings. However, under the Storey embodiments, a thicker pick can create even greater obstructions with the strings if the lateral intermediate segments, being of relative thinness, make contact with the strings Finally, although a "metal tip" is described, the patent does not detail or exploit the range of materials that can be used, not only as to the tip, but as to the entire lower portion of the pick, or more importantly, the flexible intermediate portion. Materials such as metal alloys, graphite, fiberglass, plastics, and others, all possess different degrees of rigidity, material memory, rates of recoil or response, and ultimately, different degrees of tactile sensitivity to the player.

The present invention is based upon an understanding that there is a long unsatisfied need for an improved pick that allows the player to incorporate various rigid materials for distinct tonal differences, an unobstructed surface that will not grab or rake the strings, and that can incorporate different flexible materials for a preferred action and tactile sensitivity, while still maintaining the ability to comfortably and quickly transition between varying degrees of stiffness without rotating, adjusting, or vertically shifting the player's orientation upon the pick.

SUMMARY OF THE INVENTION

Accordingly, it is a primary object of the present invention to provide a pick for stringed musical instruments comprising an upper body, a generally triangular shaped lower body with appendages extending adjacent to the planar perimeter of the upper body, and an intermediate portion of less width that the upper and lower body, and having a greater flexibility that the upper and lower body. As the upper body of the pick is held between the player's thumb and index finger, the intermediate portion promotes flexibility despite the rigidity of the lower body. As the player requires a stiffer pick application, the modification is accomplished simply by engaging the appendages of the lower body through the application of more pressure upon the pick, thereby flattening the thumb and index finger onto the adjacent lower body appendage, or by rolling the thumb and finger in a more natural lateral fashion. Likewise, a return to greater flexibility is accomplished by simply disengaging the appendages According to a preferred embodiment, the flexibility in the intermediate portion is created by voids in the material between the upwardly extended lower body appendages and the intermediate portion.

In an alternative embodiment, the pick may also have a single side with the upwardly extended lower body appendage, and a common opposing side of a substantially linear and unobstructed composition, so as not to grab or rake the strings.

In an alternative embodiment, the intermediate portion may be composed of materials with different capacities for flexibility, material memory, recoil or response, and tactile sensitivity, such as, metal, metal alloys, graphite, fiberglass, plastics, and other materials.

In an alternative embodiment, the upper body and lower body may be composed of different materials to create distinct tonal differences, such as metal alloys, graphite, fiberglass, plastics, and other materials.

In an alternative embodiment, the upper body and lower body may be a greater thickness to provide a more comfortable feel for the player, and allow for a more graduated or tapered tip.

In an alternative embodiment, the intermediate portion may pivot or hinge by means of different configurations such as flat springs, coiled springs, hinges, and other means.

BRIEF DESCRIPTION OF THE DRAWINGS

Still other advantages will become apparent from the following specification and drawings.

DETAILED DESCRIPTION OF THE DRAWINGS

Figure 1:
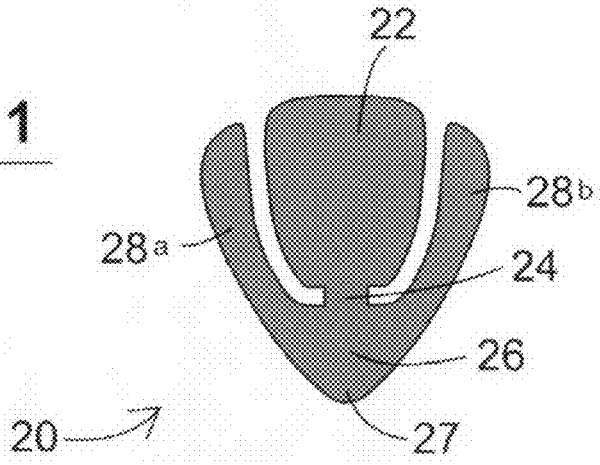
FIG. 1 is a front view of the pick of the present invention.

FIG. 1 is a front view of a preferred embodiment of the generally triangle-shaped pick 20 that incorporates an upper body 22, intermediate portion 24, lower body 26, and upwardly extending appendages 28*a* and 28*b* that extend beyond the intermediate portion 24, and terminate adjacent to the planar perimeter of the upper body 22.

Figure 2:
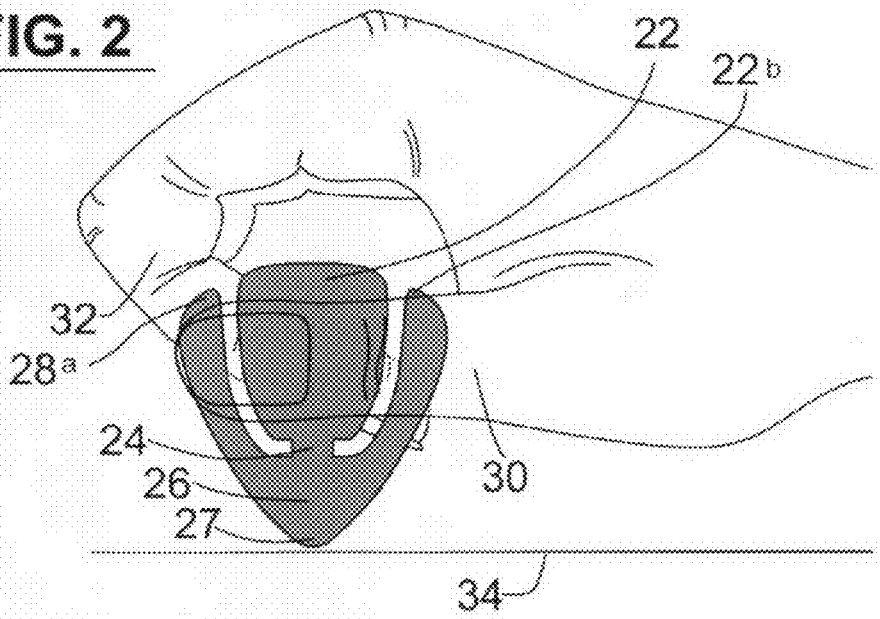
FIG. 2 is a front view of the pick of the present invention as held by a player in the playing orientation upon a stringed instrument.

FIG. 2 is a front view of the pick 20 as held by a player in the playing orientation upon a stringed instrument. The player generally sandwiches the thumb 30 and index finger 32 on opposing sides of upper body 22 while strumming or plucking the string or strings 34 by means of contact with the lower body 26, and principally with the tip 27.

During the course of play, a player often desires to quickly and easily transition between the softer, quieter, and less resonant tones produced by a more flexible pick, and the harder, louder, and more resonant tones produced by a more rigid pick. This transition must often be accomplished immediately between strumming and plucking, and because both hands are used in the play of stringed musical instruments, any transition must be swift, single-handed, and not involve complex and/or strained or uncomfortable single-hand manipulations. Further, the vertical orientation of the player's thumb and index finger upon the pick is often quite particular to the player, and any vertical dislocation often results in awkward or inaccurate play.

As shown in FIGS. 1 and 2, the narrower intermediate portion 24 creates increased flexibility of pick 20 because of the relative lack of material compared to the wider portions of upper body 22 and lower body 26. Further, the width of the intermediate portion 24 can be easily increased or decreased upon manufacture to provide a maximum base of flexibility for different playing preferences. Likewise, the maximum rigidity of the pick 20 can be easily increased or decreased by incorporating harder or thicker base material upon manufacture.

Figure 3:
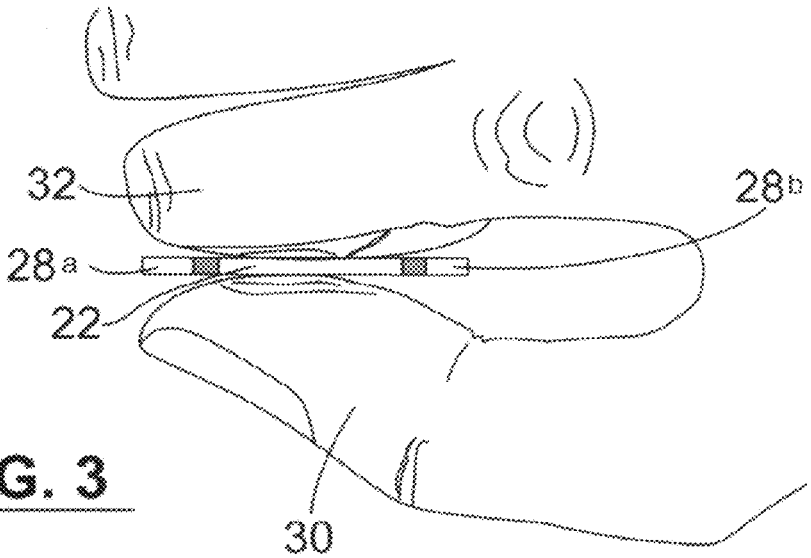
FIG. 3 is a top view of the pick of the present invention as held by a player in the flexible position.
Figure 4:
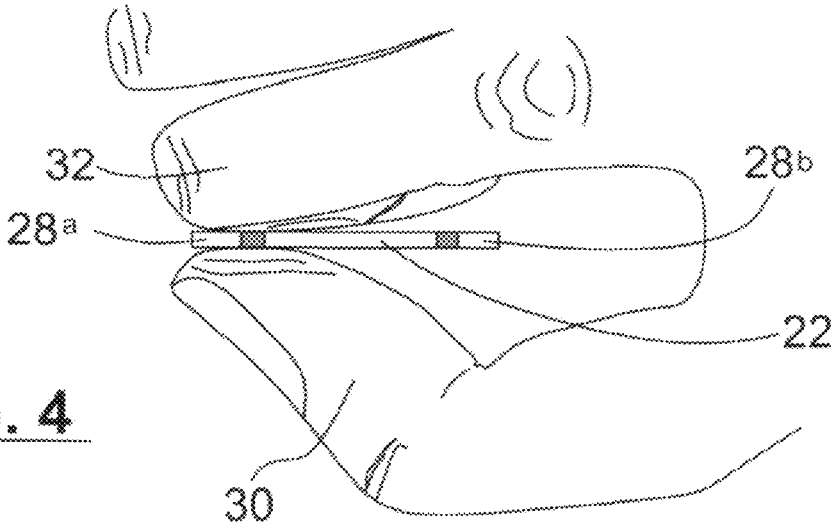
FIG. 4 is a top view of the pick of the present invention as held by a player in the stiffer position.

FIG. 3 is a top view of the pick 20 as held by a player in the more flexible position. Upon this orientation, a player can adjust the stiffness, as detailed in FIG. 4, between the maximum flexibility of the intermediate portion 24, and the maximum rigidity provided by the base material and thickness of pick 20, by engaging the otherwise separated appendages 28*a* and/or 28*b*, with slight pressure, thereby flattening the tissues of thumb 30 and finger 32, and/or a minute and comfortable horizontal finger roll that is ergonomically in-keeping with the parallel forearm, hand, thumb 30, and string 34 orientation described in FIG. 2. Additionally, the varying degrees of pressure or finger roll applied by the player can modulate between the varying degrees of rigidity in the pick 20 by tightening or loosening the tension upon appendages 28*a* and/or 28*b*. Further, this configuration has the added benefit of not displacing the preferred vertical orientation of the player's thumb 30 and finger 32 upon pick 20.

Figure 5:
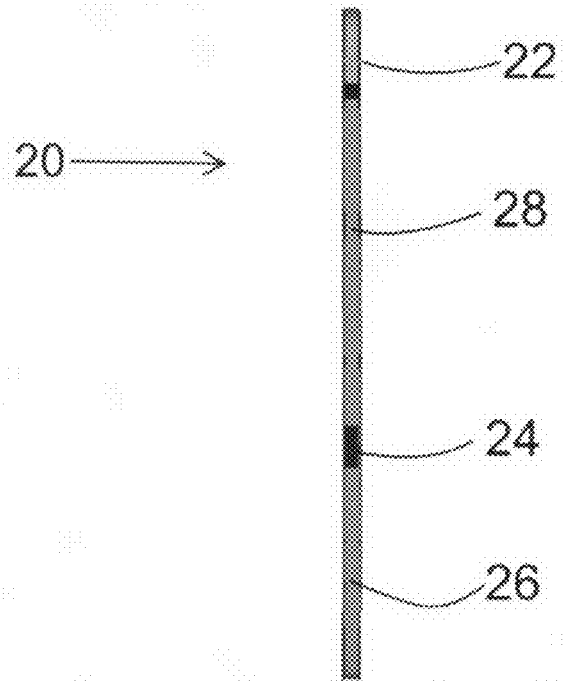
FIG. 5 is a side view of the pick of the present invention.

Still added benefits are to be realized by this configuration. FIG. 5 is a side view of pick 20. Prior attempts have been made to thin or otherwise scallop intermediate sections of the pick material to create flexibility. However, such attempts often, if not necessarily, create obstructions in the pick which grab or rake the strings, thereby dislocating the pick from the player's hand, creating unintended sounds, interrupting play, or possibly breaking the strings. As shown in FIG. 5, not only is the entire pick 20 of a flat and even surface without obstructions, but the leading edges of lower body 26 and appendages 28 extend beyond any reasonable contact potential with string 34, thereby providing an unobstructed surface during contact.

Further, FIGS. 1-5 demonstrate that the pick 20 can be easily manufactured by means of die-cutting, or otherwise stamping, the invention from a simple sheet material substrate, without the added processes described in prior art references regarding thinning, scalloping, or other wise pretreating the substrate to be die-cut, or the relatively more expensive process of injection molding.

Figure 6:
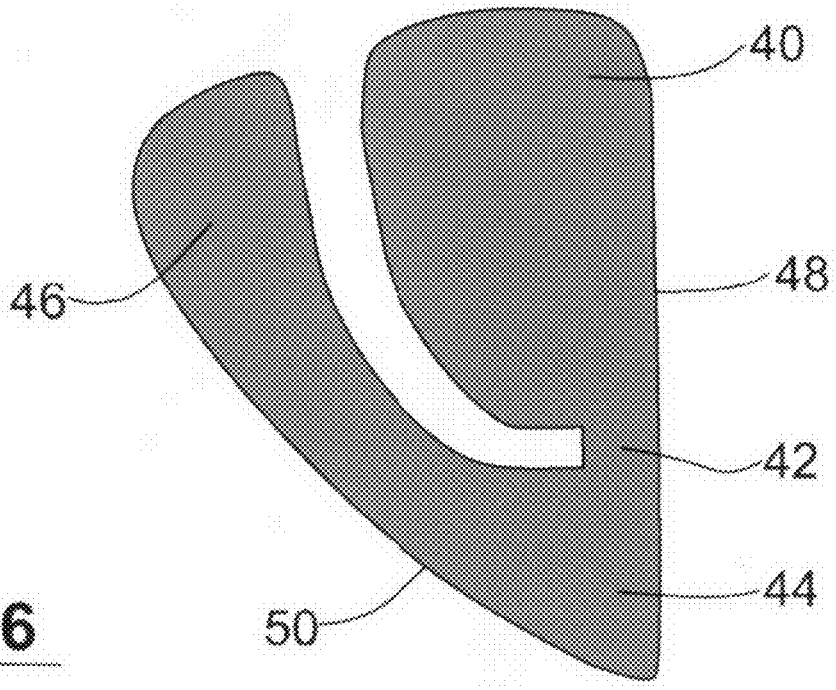
FIG. 6 is a front view of a second embodiment of the present invention.

FIG. 6 is a front view of a second embodiment of the present invention in which the player maintains the above described benefits, but accommodates a player's preferred manner of engaging appendage 46. A player sandwiches a thumb and index finger upon opposing sides of upper body 40, and similarly avails himself of the flexibility of the intermediate portion 42, while maintaining the ability to engage appendage 46 either in front of or behind the thumb. Similarly, the flat construction of the pick, and leading edges 48 and 50 prevent undue obstructions while contacting the strings.

Figure 7:
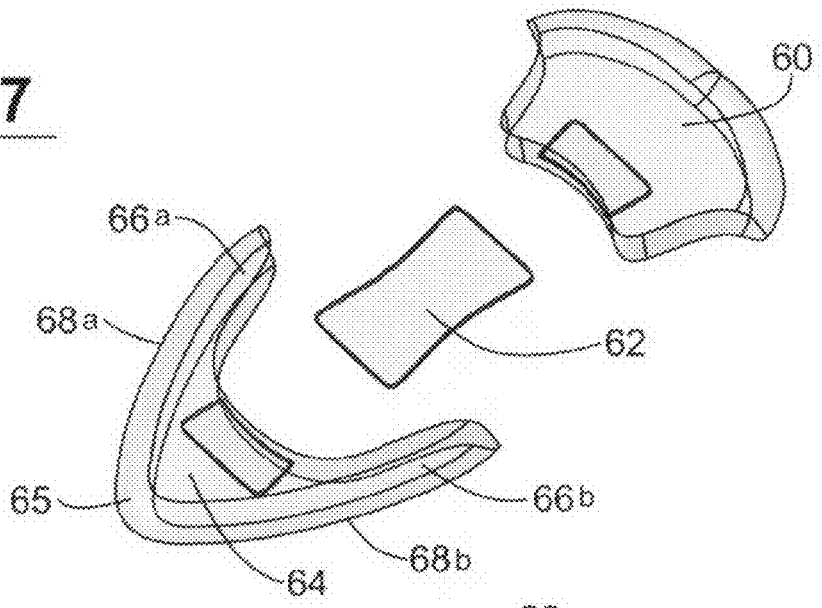
FIG. 7 is an exploded perspective view of a third embodiment of the present invention.
Figure 8:
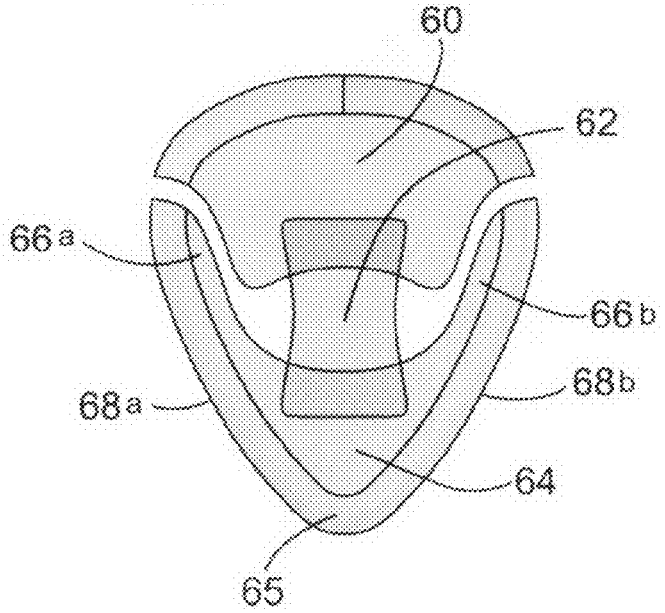
FIG. 8 is a front view of a third embodiment of the present invention.

FIG. 7 is an exploded view of a third embodiment, and FIG. 8 is a front view of the same in which the upper body 60, intermediate portion 62, and lower body 64 may be composed of different materials. It is often desirable for players to incorporate different materials and thicknesses in order to produce unique tones, create a range of flexibility, and to accommodate the players preferred playing technique.

As referenced in FIGS. 1-6, flexibility is created in the intermediate portion 24 by being comparatively narrower than the upper body 22 and lower body 26. As shown in FIG. 7, the intermediate portion 62 may also incorporate a variety of materials with different flexibilities in order to accomplish the same or similar function, with added beneficial properties. It is often desirable, in the course of play, for the lower body 64 to recoil or rebound quickly to its original position as the player speedily plucks or strums the strings. In addition to the flexibility of the intermediate portion 62, that is, the capacity of a material to be easily bent or shaped, a player's tonal and technical preferences may require a material with greater material memory and rate of recoil. Material memory is the capacity of a material to return to a previous shape after deformation, and recoil describes how fast that action happens. By way of illustration, a partial list of materials that exhibit different capacities for flexibility, material memory, and recoil include spring steel, metal alloys, graphite, fiberglass, plastics, and other materials.

By means of the materials and configuration described in FIGS. 7 and 8, the pick of the present invention can accommodate multiple playing styles, tonal qualities, flexibilities, and rates of recoil to suit individual playing preferences and techniques. Still a further benefit may include greater feel and tactile sensitivity available to the player. A player must often make speedy, precise, and minute adjustments while plucking or strumming the strings. If a pick lacks feel or tactile sensitivity, a player must hear the note sounded before the player can appreciate the quality and manner in which that note was struck, and then make adjustments in form therefrom. The embodiment described in FIGS. 7 and 8 can mitigate such delays by instantly transmitting the minute movements, and contact characteristics with the string, instantly to the player's fingertips. This often results in faster and more accurate play. Analogously, fishing poles are often tapered and composed of fiberglass or graphite so that a fisherman can feel the otherwise imperceptible nibbles of a fish upon the end of the fishing line. In a similar manner, the player can feel, correct, and/or anticipate a speedy and prolonged series of incredibly minute and subtle movements by means of this embodiment.

Additionally, the upper body 60 and lower body 64 may be composed of different materials to produce a variety of distinct tones when plucking or strumming the strings. "Tone" is often used in a general sense to describe different sound qualities and phenomena. As mentioned in FIGS. 1-6, the flexibility of the pick creates harder or softer, and quieter or louder tones. Similarly, bust distinctly, the material used in the lower body 64 can create different sound qualities as it makes contact with the strings. Although the vernacular is often lacking and analogous, a metal pick will often make a clean, sharp, and "metallic" sound as it strikes metal strings. Conversely, a softer material will produce a more muted or muffled sound. Likewise, plastics, graphite, fiberglass, and other materials may produce unique and individual tones. Therefore, the materials and configuration described in FIGS. 7 and 8 allow for a highly versatile and specialized pick to accommodate a player's preferences.

Figure 9:
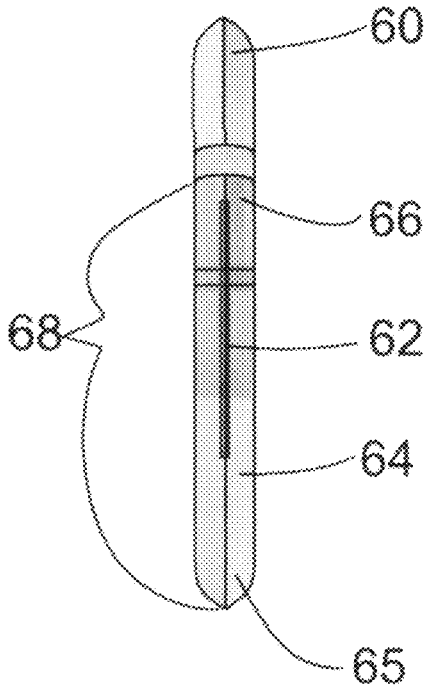
FIG. 9 is a side view of a third embodiment of the present invention.
Figure 10:
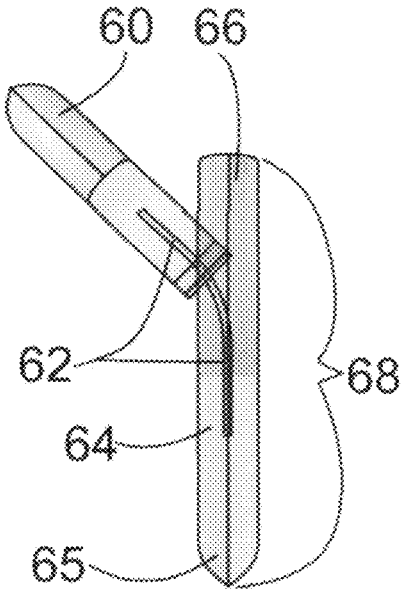
FIG. 10 is an operational side view of a third embodiment of the present invention.

FIG. 9 is a side view of the embodiment described in FIGS. 7 and 8, and FIG. 10 is an operational view of the same as it pivots or flexes upon the intermediate portion 62. It is often desirable to taper or graduate the tip 65 so that, as contact is made with the string, the string may "roll off" of tip 65 instead of the "slapping" of a non-tapered tip of a flat pick. FIGS. 7-10 describe a manner and method in which a thicker lower body 64 can accommodate a graduated or tapered tip 65 without sacrificing the flexibility of the pick. Likewise, the upper body 60 may be increased in thickness and texture to create a more substantial gripping surface according to the player's preference.

Further, it is often undesirable to grab or rake the strings because of obstructions or variations in the thicknesses of the pick. FIGS. 7-10 demonstrate that, although the intermediate portion 62 may be of a different relative thickness as compare to upper body 60 and lower body 64, the smooth leading edges 68*a* and 68*b* guide the string free of any obstructions or variations in the thickness of the pick.

It is anticipated that the embodiment described in FIGS. 7-10 may be produced by over-molding upper body 60 and lower body 64 to intermediate portion 62. Other means of attachment may include, but are not limited to, metal welding, sonic welding, gluing, barbed edges of the intermediate portion 62 which affix to recessed receiver cavities of upper body 60 and lower body 64, and like methods.

Figure 11:
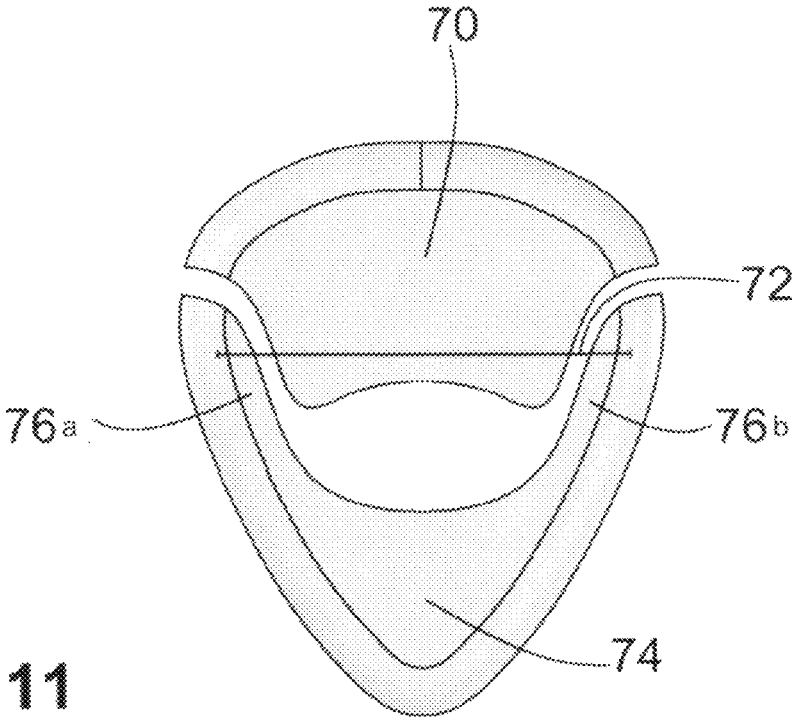
FIG. 11 is a front view of an alternative hinging mechanism.

FIG. 11 is a front view of an optional means of flexing or pivoting the intermediate portion 72. In this embodiment, a through rod 72 is inserted through apertures in the upper body 70 and appendages 76*a* and 76*b*. A pivot point is created by affixing the through rod 72 to the upper appendages 76*a* and 76*b*, while still allowing the upper body 70 to rotate freely upon through rod 72. This optional means of flexing or pivoting is desirable for players who prefer a complete lack of recoil or material memory. By such means, the player may minutely adjust the stiffness of the pick by easily engaging appendages 76*a* and 76*b*. Further, washers or spacers may be applied to through rod 72, and between the upper body 70 and appendages 76*a* and 76*b* to center or increase the lateral stability of the upper body 70. Similarly, the through rod 72 may remain affixed to upper body 70 while rotating freely within the apertures of appendages 76*a* and 76*b*.

Similarly, it is anticipated that the intermediate portion may pivot or hinge by means of different configurations such as flat springs, coiled springs, hinges, and other means of affecting a flexible or pivoting point.

From the above descriptions and illustrations, it will be apparent to those of ordinary skill in the relevant art that some changes and modifications may be made without diminishing the inventive and principled concepts of the present invention.

What is claimed is:

1. A pick or plectrum for stringed musical instruments comprising: an upper body; a lower body comprising: a generally triangular shape, with appendages extending adjacent to the outer planar perimeter of said upper body, and having smooth or unobstructed outer edges so as not to grab or rake the strings; and an intermediate portion having greater flexibility than said upper body and said lower body whereby a player may sandwich said upper body between the thumb and index finger, or between other fingers, said lower body is used to pluck or strum the strings, and whereby a player may decrease or increase the flexibility of the pick by using the thumb and index finger or other fingers to engage or disengage said lower body and/or said lower body appendage or appendages.

2. A pick, as defined in claim 1, wherein the said upper body, said lower body, and said intermediate portion share a common side that is substantially linear and uninterrupted.

3. A pick, as defined in claim 1, wherein said intermediate portion is composed of flexible metal alloy, graphite, fiberglass, plastic, or other materials with similar properties.

4. A pick, as defined in claim 1, wherein said upper body and/or said lower body is composed of rigid metal alloy, graphite, fiberglass, plastic, or other materials with similar properties.

5. A pick, as defined in claim 1, wherein the said lower body is of enough thickness to create a compound tapered or graduated edge at the point of contact with the string(s) of a stringed instrument.

6. A pick, as defined in claim 1, wherein the said intermediate portion comprises an alternative pivot or hinge mechanism such as flat springs, coiled springs, through rods, hinges, or other similar mechanisms.

* * * * *